US007520829B2

(12) United States Patent
Mollner et al.

(10) Patent No.: US 7,520,829 B2
(45) Date of Patent: Apr. 21, 2009

(54) HOCKEY STICK

(75) Inventors: Brian C. Mollner, San Diego, CA (US); David Lemire, San Diego, CA (US); Joseph M. Omaña, III, San Diego, CA (US)

(73) Assignee: True Temper Sports, Inc., Memphis, TN (US)

( * ) Notice: Subject to any disclaimer, the term of this patent is extended or adjusted under 35 U.S.C. 154(b) by 0 days.

(21) Appl. No.: 11/772,662

(22) Filed: Jul. 2, 2007

(65) Prior Publication Data

US 2009/0011876 A1 Jan. 8, 2009

(51) Int. Cl.
*A63B 59/14* (2006.01)

(52) U.S. Cl. ..... 473/562; 473/563

(58) Field of Classification Search ..... 473/560–563, 473/311

See application file for complete search history.

(56) References Cited

U.S. PATENT DOCUMENTS 4,358,113 A * 11/1982 McKinnon et al. ..... 473/561
4,537,398 A * 8/1985 Salminen ..... 473/561
4,684,130 A * 8/1987 Drolet et al. ..... 473/562
5,380,005 A * 1/1995 Hsu ..... 473/311
5,865,696 A * 2/1999 Calapp et al. ..... 473/561
6,062,996 A * 5/2000 Quigley et al. ..... 473/563
6,257,999 B1 * 7/2001 Dahm ..... 473/563
6,626,775 B2 * 9/2003 Tiitola ..... 473/563
6,893,596 B2 5/2005 Haas et al.
2003/0004019 A1 * 1/2003 Lussier et al. ..... 473/563
2004/0229720 A1 11/2004 Halko et al.

* cited by examiner

*Primary Examiner*—Mark S Graham
(74) *Attorney, Agent, or Firm*—Harness, Dickey & Pierce, P.L.C.

(57) ABSTRACT

A one-piece composite hockey stick includes a shaft and a blade. The blade end of the shaft extends entirely through the blade such that the blade end can contact the playing surface along with the bottom side of the blade. The shaft extending through the bottom side of the blade can provide a user with an enhanced feel and improved playing characteristics by providing continuous fibers that extend from the grip of a user to the playing surface through the shaft. The shaft can be hollow and open on the blade end such that the interior cavity of the shaft can be accessed from the bottom side of the blade. One or more inserts can be selectively disposed in the interior cavity of the shaft to provide a desired weight distribution and/or damping characteristics.

15 Claims, 5 Drawing Sheets

HOCKEY STICK

FIELD

The present teachings relate to composite hockey sticks and, more particularly, to one-piece composite hockey sticks having a shaft and blade interface that may provide superior playing characteristics.

BACKGROUND AND SUMMARY

The statements in this section merely provide background information related to the present teaching and may not constitute prior art.

Traditional composite hockey stick construction can include the coupling of a blade with a shaft to form a one-piece hockey stick. The blade can include a male tongue, or tenon, at the shaft end of the blade. The tenon slides into a mating opening in the shaft. The blade is then bonded to the shaft to form a mechanical joint. The added weight of the joint, the mechanical play inherent in the joint, and the inherent yield of the bonding material can adversely affect the play of the stick.

Other types of composite hockey sticks may include a shaft that is formed first with a blade subsequently molded around a portion of the shaft at the blade end to form a one-piece hockey stick. For example, a blade can be molded around a portion of a shaft via resin transfer molding to create a mechanical joint with the end of the shaft extending partially into the blade. The resulting mechanical joint can have wall thicknesses that are inconsistent and thereby provide inconsistent flexing characteristics for the joint.

Regardless of the type of mechanical joint employed, prior art mechanical joints adversely affect the flex and mechanical integrity of hockey sticks. For instance, since the mechanical joint must be rigid to secure the blade to the shaft, the designer must add reinforcing material and, hence, weight to the blade end of the stick. For example, some composite hockey stick constructions use foam and/or additional material to reinforce the joint and occupy the voids in the interface between the shaft and the blade which can add needless weight. The extra weight can adversely affect the playing characteristics. Because the added weight of the reinforced joint may lie under the end of the stick, the stick can suffer from a disproportionately large increase in moment of inertia, thereby slowing a player's downswing of the hockey stick considerably. In the alternative, the designer can accept the weak joint as is.

Worse yet, the designer, in seeking to optimize shaft flexure, must contend with an inflexible portion of the shaft, the joint, which impedes the optimization of the stick. Thus, the energy transfer of a stick with a mechanical joint may be considerably impaired.

Additionally, mechanical joints may allow mechanical play and yielding between the blade and the shaft. An example of which is the force of impact tending to cause the blade to rotate relative to the shaft.

Further, mechanical joints can result in wall thicknesses that are inconsistent and thereby provide inconsistent flexing characteristics for the joint formed between the blade and the shaft. Because the blade is in contact with the playing surface, the forces transmitted through the composite hockey stick travel through the blade, through the interface of the mechanical joint, and up the shaft to the user of the composite hockey stick. Due to the inconsistent wall thicknesses, the excessive use of foam or excess material that increases the weight, and the inconsistent nature of the stiffness of the composite hockey stick from the point of contact with the ice surface to the user's hands, the playing experience can be less than optimal.

Accordingly, it would be desirable to eliminate the mechanical joint between the blade and the shaft of a composite hockey stick. It would also be desirable to provide a stiffness of the composite hockey stick that is relatively consistent from the grip end all the way through the heel of the blade to the interface with the playing surface. It would further be advantageous if the weight of the shaft could be adjusted to provide desired playing characteristics. It would be still further advantageous if the weight distribution of the composite hockey stick were able to be adjusted by the user of the composite hockey stick.

In accordance with the present teachings, a composite hockey stick includes a shaft that extends from the grip end all the way through the blade to the playing surface. The blade end of the shaft extends through an opening in the bottom side of the blade to contact the playing surface. The shaft can thereby provide continuous fibers that connect a user's hands with the playing surface through the shaft. The extension of the shaft through the blade and onto the playing surface can allow the designer to incorporate a stiffness of the shaft that is relatively consistent along its length and can provide improved playing characteristics. The shaft can be hollow and open at its blade end such that the interior cavity is accessible through the bottom side of the blade. The accessible interior cavity can allow one or more inserts to be selectively disposed in the interior cavity of the shaft to provide a desired weight distribution and/or damping characteristic of the hockey stick.

The shaft can be formed from composite materials and cured first with the blade being subsequently cured onto the end of the shaft, such as via compression molding, resin transfer molding, bladder molding, or wet lay-up by way of non-limiting example. The blade can include a through opening that entirely radially surrounds a portion of the shaft adjacent the blade end. Entirely radially surrounding a portion of the blade end of the shaft with a portion of the blade increases the surface area of contact between the shaft and the blade and the infusion of the resin of the blade into the shaft, thereby providing a secure attachment between the blade and the shaft.

Further areas of applicability will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

DETAILED DESCRIPTION

Figure 1:
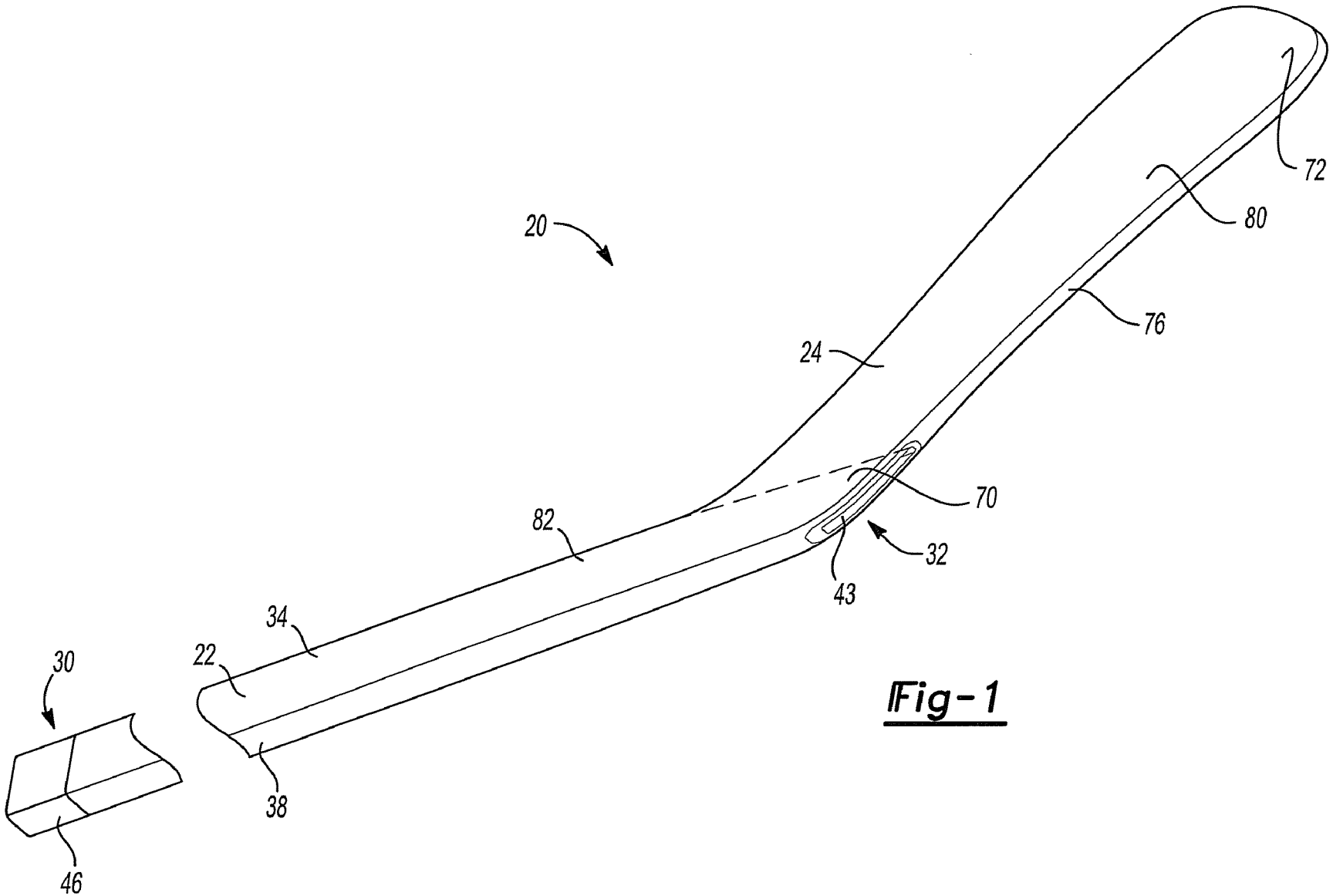
FIG. 1 is a perspective view of a one-piece composite hockey stick according to the present teachings.
Figure 2:
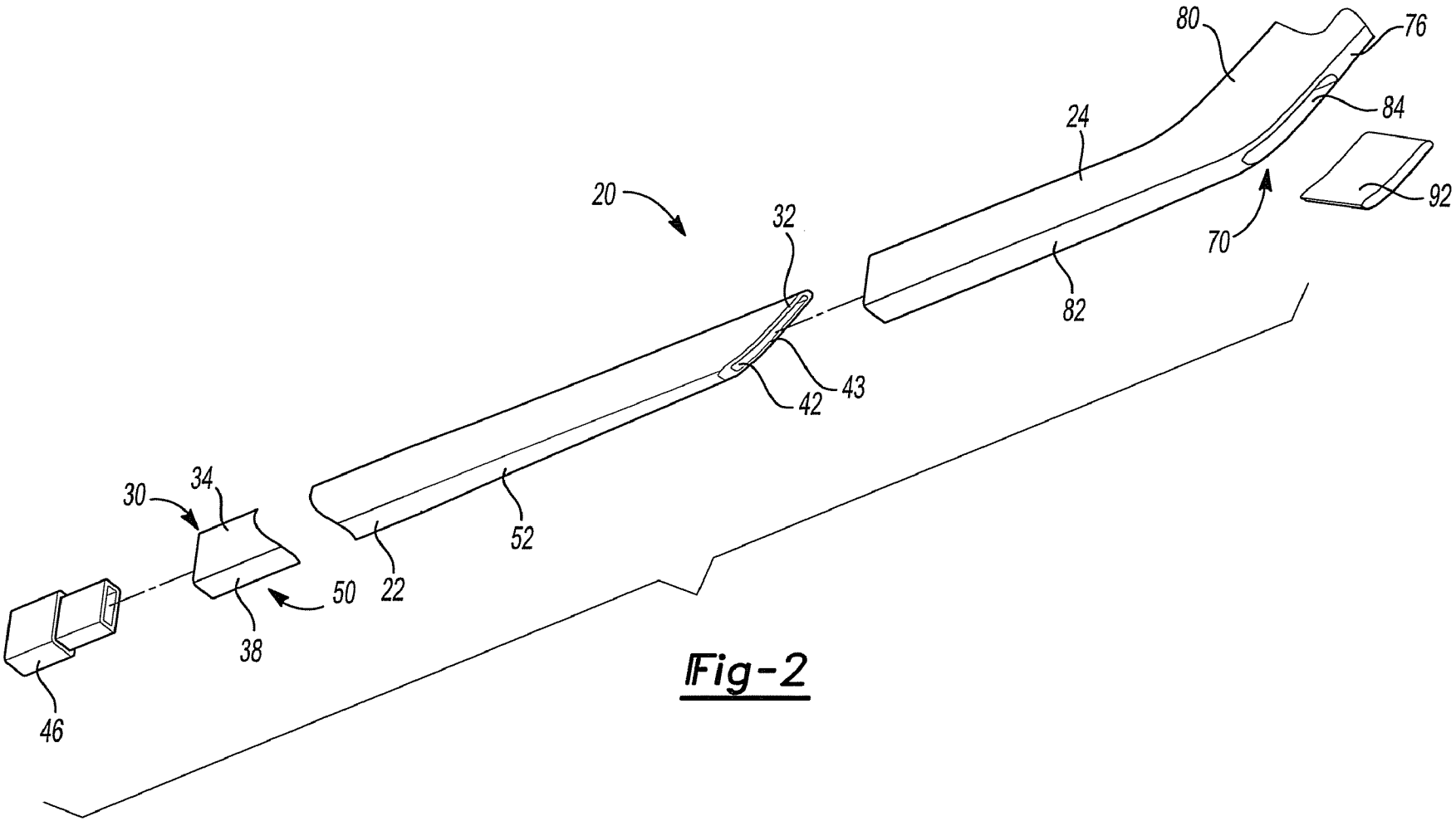
FIG. 2 is a fragmented assembly view of the hockey stick of FIG. 1.
Figure 3:
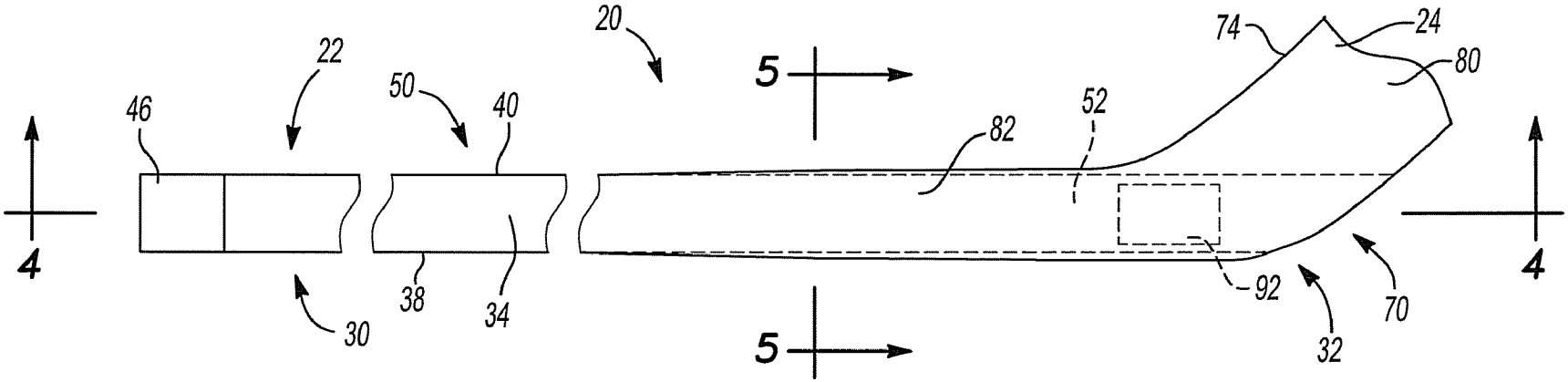
FIG. 3 is a fragmented side plan view of the hockey stick of FIG. 1.
Figure 4:
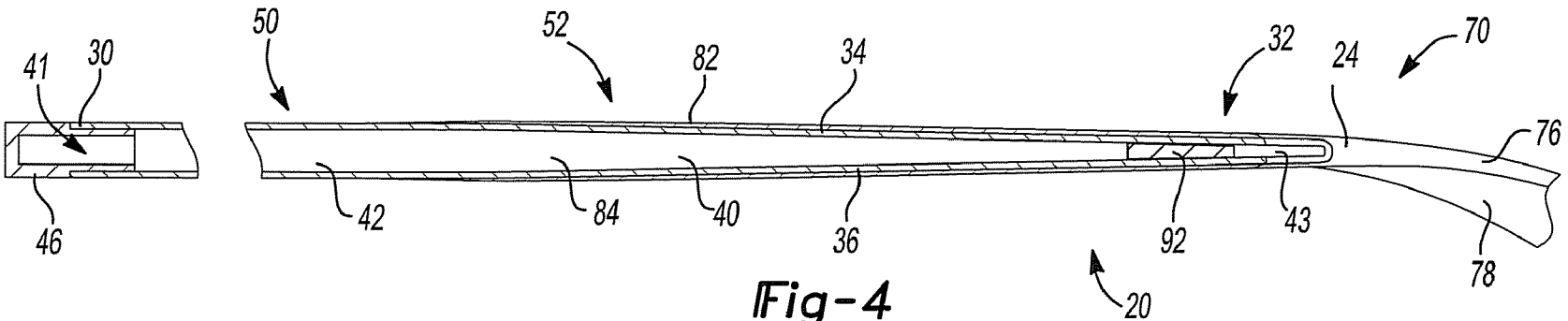
FIG. 4 is a fragmented cross-sectional view of the hockey stick of FIG. 3 along line 4-4.
Figure 5:
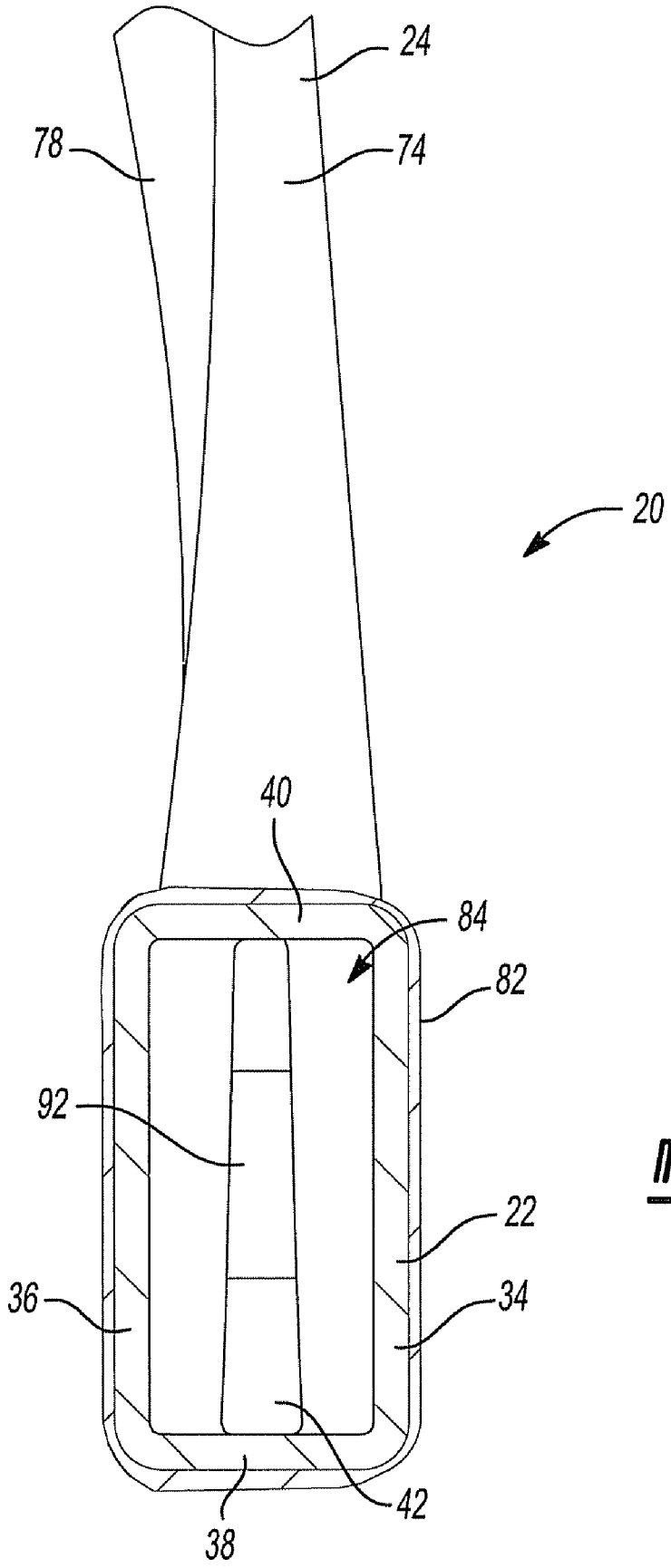
FIG. 5 is a fragmented cross-sectional view of the hockey stick of FIG. 3 along line 5-5.

The following description is merely exemplary in nature and is not intended to limit the present teaching, application, or uses.

Referring to FIGS. 1-5, a one-piece composite hockey stick 20 according to the present teachings is shown. Hockey stick 20 includes a shaft 22 coupled to a blade 24. Shaft 22 and blade 24 are fixed together to form a one-piece hockey stick. As used herein, the term "one-piece" hockey stick means that the blade and shaft are permanently coupled together and are not intended to be separated one from another after construction regardless of the manufacturing process used to achieve such construction.

Shaft 22 includes a grip end 30 and a blade end 32. Shaft 22 is generally rectangular in cross-section and includes a first pair of parallel sides 34, 36 and a second pair of parallel sides 38, 40 that are generally perpendicular to the first pair of parallel sides 34, 36. First pair of parallel sides 34, 36 may be wider than second pair of parallel sides 38, 40. Sides 34, 36, 38, and 40 may be of thin-wall construction. Shaft 22 includes openings 41, 43 at grip and blade ends 30, 32, respectively, and includes an interior cavity 42 extending therebetween. An end piece 46 can be disposed in opening 41 of grip end 30 of shaft 22.

Shaft 22 includes a non-tapering portion 50 and a tapering portion 52. Non-tapering portion 50 has a generally constant dimension with the dimensions of sides 34, 36, 38, 40 being generally uniform as non-tapering portion 50 extends longitudinally along shaft 22. Tapering portion 52 has a dimension that changes as it extends from non-tapering portion 50 toward blade end 32. Particularly, the width of sides 38, 40 decreases as tapering portion 52 extends toward blade end 32. Sides 34, 36, however, may decrease in width or maintain a substantially uniform width as tapering portion 52 extends longitudinally toward blade end 32. Tapering portion 52 is configured to fit within a through opening of blade 24, as described below. Blade end 32 is complementary to the heel portion of blade 24.

Blade 24 includes a heel portion 70 adjacent shaft 22 and a toe portion 72 spaced therefrom. Blade 24 includes opposite top and bottom sides 74, 76 that extend between heel and toe portions 70, 72. Blade 24 includes front and back surfaces 78, 80 that extend between top and bottom sides 74, 76. Blade 24 includes a neck portion 82 that extends upwardly from heel portion 70 above top side 74. Blade 24 includes a through opening 84 that extends through neck portion 82 and heel portion 70. Through opening 84 extends through bottom side 76. Blade 24 can include a foam core.

Through opening 84 is configured to receive tapering portion 52 of shaft 22 with blade end 32 substantially flush with bottom side 76. Cavity 42 of shaft 22 can be accessed from bottom side 76 of blade 24 through opening 43. Additionally, blade end 32 of shaft 22 can contact the playing surface along with bottom side 76 of blade 24 during use. As a result, shaft 22 provides a continuous interface from the hands of a user all the way to the playing surface through blade 24.

Neck portion 82 of blade 24 can taper as it extends toward heel portion 70 and bottom side 76. The tapering of neck portion 82 is complementary to tapering portion 52 of shaft 22 thereby facilitating the attachment of shaft 22 to blade 24. Neck portion 82 radially surrounds an entirety of tapering portion 52 with blade end 32 being accessible through through opening 84.

Shaft 22 and blade 24 form a one-piece composite hockey stick 20. Shaft 22 and blade 24 can be formed from a composite material known as pre-preg (composite fibers that have been pre-impregnated with resins). Available composite materials have various modulus (strength) ratings suitable to meet the requirements for each individual shaft and blade design. Carbon fibers, aramid fibers, such as those available under the Kevlar®, fiberglass fibers, and various combinations thereof, by way of non-limiting example, are suitable pre-preg materials for use in the present hockey stick.

Hockey stick 20 can be made using a variety of manufacturing processes. Shaft 22 can be made and cured prior to coupling with blade 24. To make shaft 22, the composite material for shaft 22 can be wrapped around a mandrel, compacted thereon, and cured in a curing oven. After curing, the mandrel can be removed from the cured shaft 22. Shaft 22 can then be cut to its final length by trimming it at grip end 30 and also at blade end 32. Blade 24 and shaft 22 can be coupled together to form hockey stick 20 using a variety of processes. For example, compression molding can be used to form hockey stick 20. In the compression molding process, a foam core for blade 24 can be wrapped with pre-preg fibers to form a pre-form. The pre-form is sized to be slightly larger than the final dimensions. The pre-form is disposed in a mold along with a cured shaft 22. The pre-preg fibers of the pre-form can be wrapped around tapering portion 52 of shaft 22. Neck portion 82 of blade 24 can be formed around an entirety of tapering portion 52 such that a through opening in blade 24 having a continuous periphery is formed and tapering portion 52 of shaft 22 occupies the through opening. Neck portion 82 radially surrounds tapering portion 52. The mold is then closed and compresses the pre-form to the final shape and blade 24 is cured onto shaft 22 therein. The foam core may expand to create additional pressure on the pre-preg fibers during the compression molding process. Once cured, hockey stick 20 can be removed from the mold.

Another suitable process includes the method and process disclosed in U.S. Pat. No. 6,893,596, entitled "Method of Forming a One-Piece Hockey Stick," assigned to the assignee of the instant application, and incorporated herein by reference. In general, shaft 22 is formed first and blade 24 is subsequently formed around and coupled thereto via resin transfer molding. The cured shaft 22 can be placed in a mold for forming blade 24 around tapering portion 52 of shaft 22. Shaft 22 can be placed in the mold so that the entire tapering portion 52 extends into the mold. Via resin transfer molding, blade 24 can be formed around tapering portion 52 of shaft 22. Neck portion 82 can be formed around an entirety of tapering portion 52 such that a through opening in blade 24 having a continuous periphery is formed and tapering portion 52 of shaft 22 occupies the through opening. Neck portion 82 radially surrounds tapering portion 52. The resin in blade 24 is allowed to cure and the mold is released. The chosen resin may have a cure time (whether catalyzed or not) and viscosity such that the resin infuses the pores between the fibers of the pre-preg material of tapering portion 52 of shaft 22 to a predetermined depth chosen according to desired properties of the finished hockey stick 20.

Additional manufacturing processes that can be utilized to form hockey stick 20 are bladder molding and wet lay-up. In bladder molding, an external/female mold has a desired final shape thereon. The blade 24 and cured shaft 22 are placed in the mold and the bladder is inflated therein to push hockey stick 20 against the mold piece and allowed to cure. In a wet lay-up process, dry fibers for a blade 24 are placed on a cured shaft 22. The resin is then brushed or rolled onto the dried fibers and the assembly is placed in a press wherein the resin infuses into the fibers and blade 24 is allowed to cure onto shaft 22. It should be appreciated that these manufacturing processes are merely exemplary and that other manufacturing processes can be employed to form hockey stick 20.

The manufacturing process of hockey stick 20 can be supplemented with vacuum-assisted, resin transfer molding. Vacuum-assisted, resin transfer molding may be employed to speed and deepen the infusion of the resin into the pre-preg material, though vacuum-assisted resin transfer molding is not required according to the present teachings.

By permeating a volume of the compacted pre-preg material near the surface to the predetermined depth, the resin forms blade 24 integral with shaft 22. Accordingly, no mechanical play will exist, nor will yielding occur, between blade 24 and shaft 22. Additionally, the insertion of the entirety of tapering portion 52 with neck portion 82 increases the fusion bonding between blade 24 and shaft 22. Moreover, the extension of shaft 22 all the way through blade 24 can eliminate the need to add foam and/or additional material.

After forming blade 24 on shaft 22, hockey stick 20 can be finished by applying aesthetic features to the surface. For example, hockey stick 20 may be painted and then cured in an oven prior to graphics being applied thereto.

The cavity 42 of shaft 22 is accessible from both grip end 30 and blade end 32. Particularly, grip end 30 can be accessed either directly or through the removal of end piece 46. Access to cavity 42 through blade end 32 can be accessed either directly or through removal of a component that may be disposed therein, such as a cap or insert. Blade end 32 of shaft 22 extends through opening 84 of blade 24. The accessibility to cavity 42 facilitates the insertion and/or removal of optional performance enhancing inserts into and from cavity 42 of shaft 22. For example, as shown in FIGS. 2-5, one or more optional inserts 92 can be disposed in interior cavity 42 of shaft 22. Inserts 92 can be selectively inserted into cavity 42 of shaft 22 through either opening 41 in grip end 30 or through opening 43 in blade end 32. Inserts 92 can be configured to achieve a desired weighting for hockey stick 20 and/or to provide a desired damping, stiffness, or other playing characteristic for hockey stick 20. The accessibility of cavity 42 from blade end 32 facilitates the positioning of inserts 92 in tapering portion 52 which can thereby facilitate the positioning of inserts 92 in the lower portion of shaft 22.

Inserts 92 can be configured to extend only partially between sides 38, 40 of shaft 22. Inserts 92 can be mechanically locked or secured within cavity 42. Additionally, adhesives or other bonding materials, such as epoxy, can be used to secure inserts 92 in cavity 42. Furthermore, friction fits can also be employed to retain insert 92 within cavity 42. Optionally, the inserts 92 can be placed in cavity 42 prior to molding blade 24 and shaft 22 together. Moreover, insert 92 can be configured to be flush with blade end 32 such that it is also flush with bottom side 76 of blade 24. It should be appreciated, however, that the location of insert 92 can vary to achieve desired playing characteristics for hockey stick 20.

Figure 6:
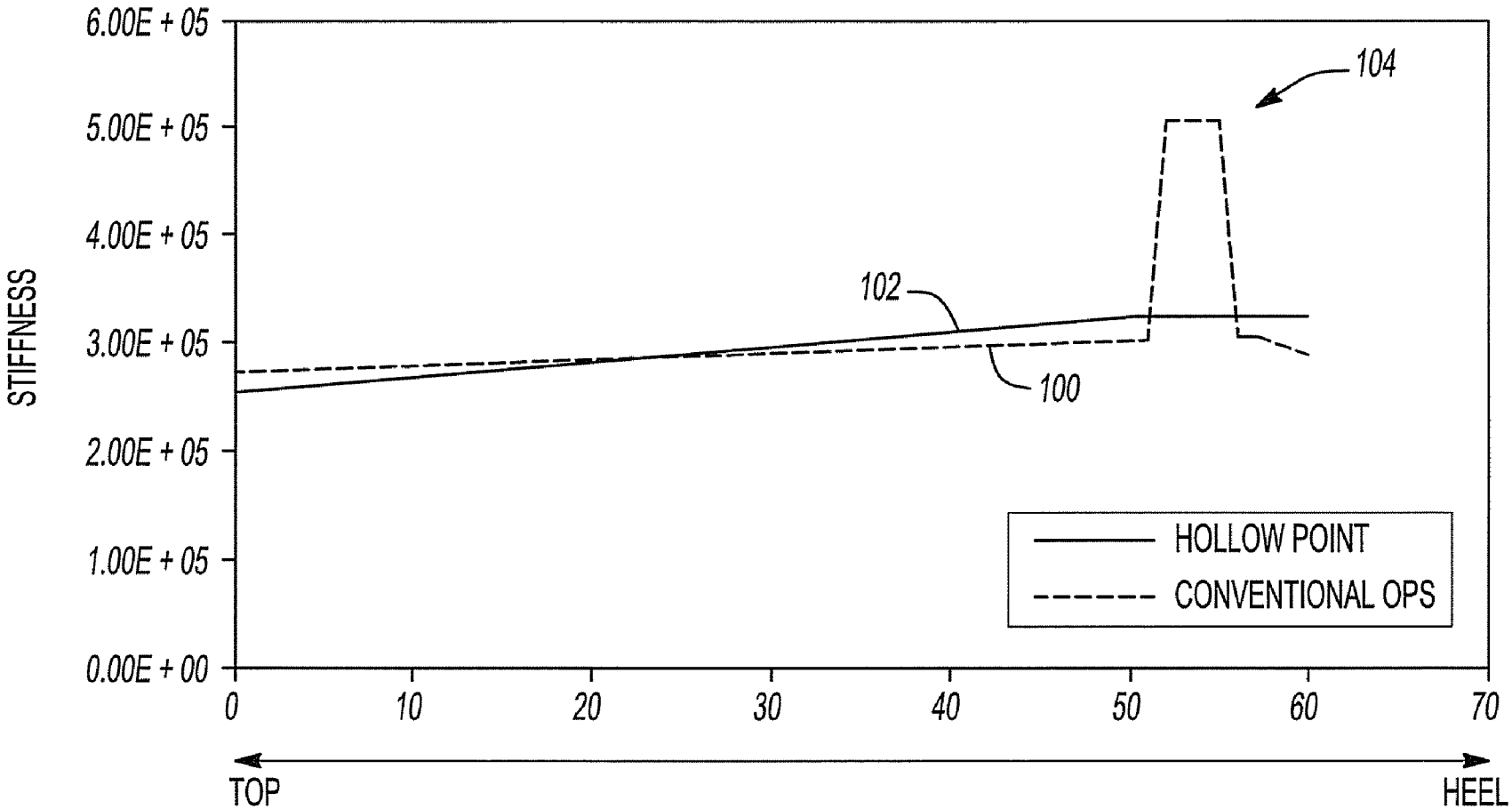
FIG. 6 is a graph comparing the stiffness of a conventional prior art one-piece composite hockey stick to a one-piece composite hockey stick according to the present teachings along the length of the hockey sticks.

Referring now to FIG. 6, an exemplary representative graphical comparison of the stiffness of a conventional prior art one-piece composite hockey stick to a one-piece composite hockey stick according to the present teachings along their length from the grip end to the interface with the playing surface is shown. The stiffness of a representative prior art hockey stick from the grip end (left side of the graph) to the interface with the playing surface (right side of the graph) is represented by line 100. The stiffness of a representative hockey stick 20 according to the present teachings from the grip end (left side of the graph) to the interface with the playing surface (right side of the graph) is represented by line 102.

As shown in line 100, the prior art hockey sticks can have a dramatic increase, indicated at 104, in stiffness just prior to the playing surface interface. This spike in stiffness is caused by the interface of the blade end of the shaft with the blade and the mechanical joint formed therebetween. For example, the spike can be caused by the double wall of a blade tenon and a shaft in a conventional prior art one-piece composite hockey stick.

In contrast, the stiffness of hockey stick 20 does not exhibit such a spike in the stiffness and, rather, shows a more uniform change in stiffness as shaft 22 extends to the playing surface through blade 24. The more uniform change in stiffness as shaft 22 extends to the playing surface through blade 24 can be an increase, a decrease, or a constant stiffness, depending on the design goals for hockey stick 20.

A benefit of hockey stick 20 is that the spike in the stiffness is significantly reduced and/or eliminated. Thus, hockey stick 20 according to the present teachings may provide a more uniform stiffness from the grip end to the interface with the playing surface than a prior art hockey stick.

The stiffness profile can be controlled by the construction of hockey stick 20, such as by aligning fibers at different angles. Additionally, the wall thicknesses and cross-sectional dimensions may be varied to change the stiffness profile of hockey stick 20. The stiffness profile of hockey stick 20 can provide improved characteristics and an improved playing experience. It should be appreciated that the graph shown in FIG. 6 is merely an exemplary graph and does not illustrate actual data.

Thus, a hockey stick 20 according to the present teachings can be an integral one-piece composite hockey stick and can provide improved playing characteristics and experiences. Shaft 22 can extend entirely through a portion of blade 24 such that blade end 32 of shaft 22 can contact the playing surface. The contacting of blade end 32 of shaft 22 with the playing surface can enhance the feel of hockey stick 20, provide improved playing characteristics, and can provide a user of hockey stick 20 with direct feedback from the playing surface through shaft 22. Additionally, by having shaft 22 extend from the grip end 30 all the way to blade end 32 and contacting the playing surface, continuous fibers in shaft 22 connect a user's hands with the playing surface thereby providing an improved playing experience. The radial encircling or surrounding of an entirety of tapering portion 52 with neck portion 82 facilitates the bonding between shaft 22 and blade 24 and can minimize and/or prevent mechanical play or yielding therebetween. Opening 43 in blade end 32 allows unfettered access to cavity 42 and can facilitate the insertion and removal of performance enhancing components, such as inserts 92. This accessibility allows for customization of hockey stick 20 to provide a desired playing characteristic. Further, it should be appreciated that the size of opening 43 in blade end 32 can vary depending upon the thickness of heel portion 70 of blade 24. The elimination of core material from the portion of shaft 22 disposed in blade 24 allows for material placement to be optimized for weight and durability of hockey stick 20. For example, in lieu of the core material, additional graphite can be utilized, thereby increasing the torsional stiffness. The increased torsional stiffness can produce a more accurate shot by reducing twist of blade 24 relative to shaft 22 during the use of hockey stick 20.

The present teachings are merely exemplary in nature and, thus, variations are intended to be within the scope of the teachings. Such variations are not to be regarded as a departure from the spirit and scope of the present teachings.

What is claimed is:

1. A one-piece composite hockey stick comprising:

a composite blade having opposite front and back surfaces and a bottom side configured to engage with a playing surface, said blade having a through opening extending through said bottom side;

an elongated composite shaft coupled to said blade, said shaft having a grip end and a blade end, said blade end disposed in said through opening of said blade with said blade end exposed to the playing surface through said opening in said bottom side of said blade, said shaft includes an interior cavity and said blade end is open to said interior cavity thereby allowing access to said cavity from said bottom side of said blade; and at least one insert disposed in said interior cavity of said shaft, said insert being entirely disposed in said interior cavity when installed in said shaft and said at least one insert is selectively removable from said interior cavity of said shaft through said blade end.

2. The one-piece composite hockey stick of claim 1, wherein said blade end of said shaft is substantially flush with said bottom side of said blade and configured to engage with the playing surface along with said bottom side.

3. The one-piece composite hockey stick of claim 2, wherein said shaft includes continuous fibers connecting said grip end to the playing surface through said blade end.

4. The one-piece composite hockey stick of claim 1, wherein said shaft includes a tapering portion extending from said blade end and said through opening in said blade is tapered.

5. The one-piece composite hockey stick of claim 1, wherein said blade includes a neck portion through which said through opening extends and said neck portion completely radially surrounds a portion of said shaft adjacent said blade end.

6. The one-piece composite hockey stick of claim 5, wherein said neck portion extends upwardly beyond a top side of said blade and radially surrounds a section of said shaft above said top side of said blade.

7. A one-piece composite hockey stick comprising:

an elongated composite shaft having a grip end and a blade end, said shaft having a hollow cavity therein, said blade end being open thereby allowing access to said cavity through said blade end;

a composite blade integral with said shaft, said blade having opposite front and back surfaces that extend between a top side and a bottom side, said bottom side configured to engage with a playing surface; and at least one insert selectively removable from said interior cavity of said shaft through said blade end, said insert being entirely disposed in said interior cavity when installed in said shaft, wherein said blade end of said shaft is accessible from said bottom side of said blade and said cavity can be accessed from said bottom side of said blade.

8. The one-piece composite hockey stick of claim 7, wherein said cavity extends from said grip end to said blade end.

9. The one-piece composite hockey stick of claim 7, wherein said shaft and said blade are made of composite material.

10. The one-piece composite hockey stick of claim 7, wherein a heel portion of said blade extends radially around an entire portion of said shaft adjacent said blade end.

11. The one-piece composite hockey stick of claim 7, wherein both said blade end of said shaft and said bottom side of said blade engage with the playing surface.

12. The one-piece composite hockey stick of claim 7, wherein said blade end of said shaft is substantially flush with said bottom side of said blade.

13. A one-piece composite hockey stick comprising:

a composite blade having opposite front and back surfaces extending between a top side and a bottom side, said bottom side configured to engage with a playing surface, said blade having a toe portion, a heel portion and a neck portion extending upwardly from said heel portion, said blade having a through opening extending from said neck portion through said heel portion and to said bottom side;

an elongated composite shaft integral with said blade, said shaft having a grip end and a blade end longitudinally spaced apart with an interior cavity extending therebetween, said shaft having a longitudinally tapering portion and a longitudinally non-tapering portion, said tapering portion being adjacent said blade end and disposed in said through opening of said blade with said blade end being substantially flush with said bottom side of said blade such that said blade end is engageable with the playing surface, and said blade end being open with said cavity accessible from said bottom side of said blade; and at least one insert selectively removable from said interior cavity of said shaft through said blade end, said insert being entirely disposed in said interior cavity when installed in said shaft.

14. The one-piece composite hockey stick of claim 13, wherein a section of said tapering portion is entirely radially surrounded by a portion of said blade.

15. The one-piece composite hockey stick of claim 13, wherein said shaft includes continuous fibers connecting said grip end to a playing surface through said blade end.

* * * * *